US008090137B2

(12) United States Patent
Ryan

(10) Patent No.: US 8,090,137 B2
(45) Date of Patent: Jan. 3, 2012

(54) WALL MOUNTABLE OBJECT WITH DIFFERENTLY SHAPED FINISH OPTIONS

(75) Inventor: Todd Ryan, Riverside, CA (US)

(73) Assignee: Dana Innovations, San Clemente, CA (US)

( * ) Notice: Subject to any disclaimer, the term of this patent is extended or adjusted under 35 U.S.C. 154(b) by 1105 days.

(21) Appl. No.: 11/923,184

(22) Filed: Oct. 24, 2007

(65) Prior Publication Data

US 2009/0110229 A1 Apr. 30, 2009

(51) Int. Cl.
*H04R 1/02* (2006.01)

(52) U.S. Cl. ..... 381/391

(58) Field of Classification Search ..... 381/391
See application file for complete search history.

(56) References Cited

U.S. PATENT DOCUMENTS

| | | | | | |
|---|---|---|---|---|---|
| 4,875,143 | A | * | 10/1989 | Fernandez | 362/86 |
| 4,887,690 | A | * | 12/1989 | Patel | 181/150 |
| 5,025,473 | A | * | 6/1991 | Carlsen et al. | 381/387 |
| 5,039,047 | A | | 8/1991 | Pitzo | |
| 5,054,956 | A | | 10/1991 | Huang | |
| 5,113,968 | A | | 5/1992 | Lemmon | |
| 5,392,261 | A | | 2/1995 | Hsu | |
| 5,403,080 | A | * | 4/1995 | Thee | 312/204 |
| 5,444,194 | A | * | 8/1995 | Reinke | 181/150 |
| 5,717,171 | A | * | 2/1998 | Miller et al. | 181/150 |
| 5,745,567 | A | | 4/1998 | Middleton | |
| D406,143 | S | * | 2/1999 | Montaldo | D14/220 |
| 6,021,208 | A | * | 2/2000 | Kin-Lung | 381/338 |
| 6,056,083 | A | * | 5/2000 | Daniell | 181/199 |
| 6,142,254 | A | * | 11/2000 | Claybaugh et al. | 181/199 |
| 6,297,450 | B1 | | 10/2001 | Yu | |
| 6,374,942 | B1 | | 4/2002 | Huggins | |
| 7,187,540 | B2 | | 3/2007 | Homer et al. | |
| 7,224,816 | B2 | | 5/2007 | Naito et al. | |
| 7,455,272 | B2 | * | 11/2008 | Monti | 248/309.1 |
| 7,801,323 | B2 | * | 9/2010 | Shain | 381/386 |
| 7,826,633 | B2 | * | 11/2010 | Davi | 381/345 |
| 7,835,536 | B2 | * | 11/2010 | Inagaki et al. | 381/335 |
| 7,921,960 | B2 | * | 4/2011 | Jacobson et al. | 181/198 |
| 2002/0011379 | A1 | * | 1/2002 | Taylor | 181/155 |
| 2004/0008856 | A1 | | 1/2004 | Naito et al. | |
| 2005/0213291 | A1 | | 9/2005 | Chi | |
| 2007/0036369 | A1 | | 2/2007 | Davi | |
| 2007/0044214 | A1 | | 3/2007 | Bordas | |
| 2008/0226096 | A1 | * | 9/2008 | Waddell et al. | 381/87 |

FOREIGN PATENT DOCUMENTS

| | | |
|---|---|---|
| JP | 2005013391 | 1/2005 |
| WO | 99-35636 | 7/1999 |

* cited by examiner

*Primary Examiner* — Ida M Soward
(74) *Attorney, Agent, or Firm* — Fish & Associates, PC

(57) ABSTRACT

A speaker mount has differently shaped coverings. Preferred speakers have a mount that is coupled to a base. The speaker has two interchangeable covers with speaker grills that fit over the mount and have two visibly different shapes.

13 Claims, 6 Drawing Sheets

WALL MOUNTABLE OBJECT WITH DIFFERENTLY SHAPED FINISH OPTIONS

FIELD OF THE INVENTION

The field of the invention is finishing options for speakers

BACKGROUND OF THE INVENTION

It is known in the art to mount speakers on any suitable surface, including for example, walls, ceilings, automobile trunks, and cabinetry. Regardless of the surface being used, it is also known to cover speakers to portray a unique look or to match a decor of the environment.

A problem arises, however, when one wishes to change the look of the speaker. U.S. Pat. No. 5,113,968 to Lemmon (May, 1992) addresses the problem with a user-replaceable grill assembly. WO 9935636 to Claybaugh (January, 1998) addresses the problem through the use of a decorative cloth speaker cover that can be painted with a design, and can be replaced with other speaker covers of different designs. These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

The known speaker systems, however, still have no methods of changing the apparent shape of the speaker housing. Existing coverings for speaker housings always conform to the shape of the underlying mount. Thus, what is still needed in the art is a speaker covering system in which the cover can be easily replaced with other covers of different sizes and shapes.

SUMMARY OF THE INVENTION

The present invention provides apparatus, systems and methods in which a fixture system that accommodates multiple finish options includes a mount coupled to a base, wherein the mount has differently shaped, interchangeable covers.

The mount can be coupled to the base in any suitable manner, including for example, magnets. In order to facilitate easy interchangeability, a detent can be used to maintain a disposition of the cover on the mount. Since contemplated covers could be asymmetric, a mechanism can advantageously be included that allows the mount to rotate relative to the base. The back side of the mount preferably has an electrical plug that automatically attaches to a mating jack when the mount is coupled to the base.

The interchangeable covers can have completely different shapes, colors, or sizes relative to one another. Among other things, different covers can have surface areas, which can advantageously differ from one another by at least 5%, and more preferably at least 20%, 30%, or even more. In especially preferred embodiments, the cover has a different overall shape from that of the mount. Thus, for example, an oval cover could be coupled to a rectangular mount, or a rectangular cover could be coupled to a rounded mount.

Where the mount includes a speaker, the cover would typically have a speaker grill. Differently shaped and sized covers can, of course, have differently shaped and sized grills, and grills can even be interchangeable relative to a given cover.

Various objects, features, aspects and advantages of the inventive subject matter will become more apparent from the following detailed description of preferred embodiments, along with the accompanying drawings in which like numerals represent like components.

DETAILED DESCRIPTION

Figure 1:
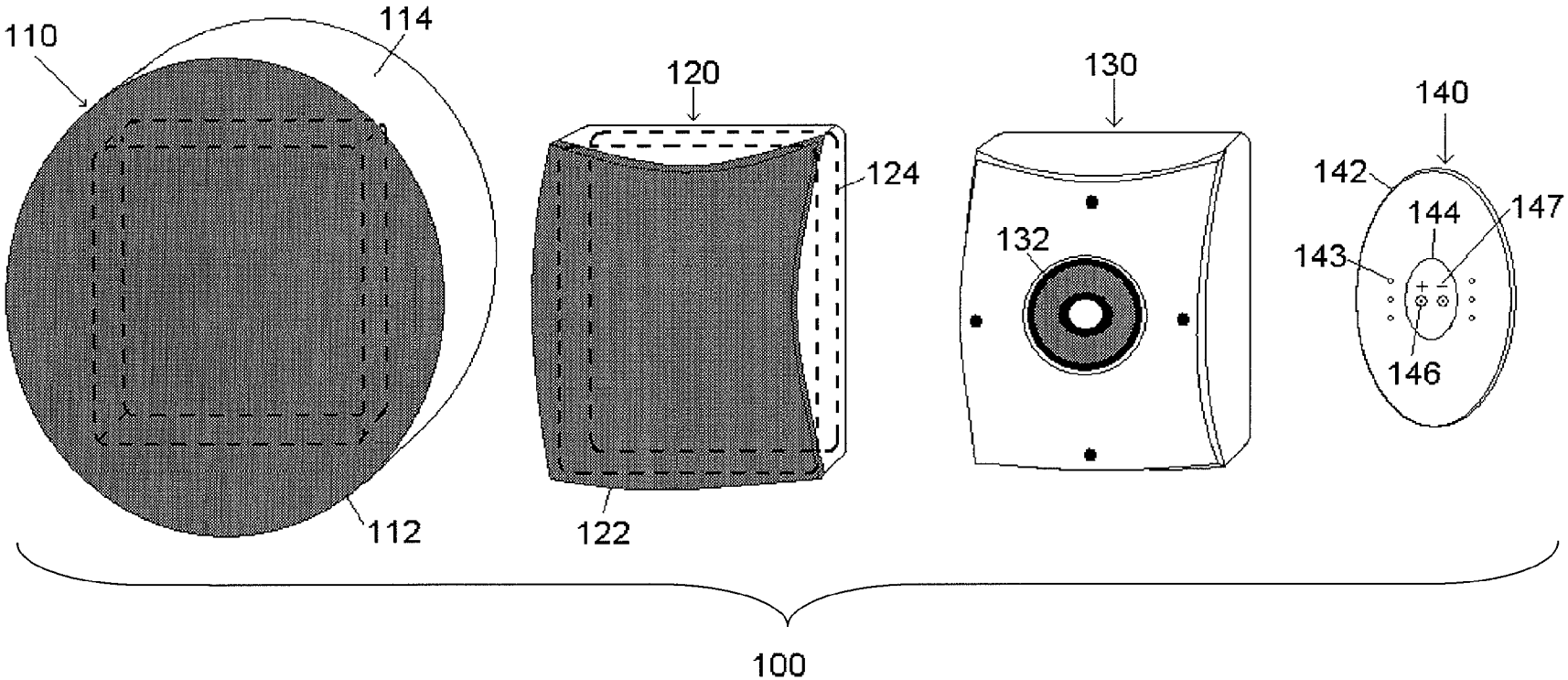
FIG. 1 is a view of a first cover, an alternative second cover, a mount and a base.

In FIG. 1 a fixture system 100 generally includes a first cover 110, a second cover 120, a mount 130, and a base 140.

First cover 110 and second cover 120 are shaped to have substantially round and rectangular perimeters, respectively, although either cover can be any suitable size or shape as long as they include a rear cavity that is able to be mounted on the mount 130. In this case first cover 110 has cavity 114 that receives mount 130, and second cover 120 has cavity 124 that couples with mount 130. Those skilled in the art will appreciate that the coupling has range anywhere from a close mating to a loose footing.

In FIG. 1, first cover 110 has an approximately round horizontal cross-section, with sides of about 25 cm. Cover 110 can have a constant height of about 6 cm, or more preferably has a height of about 6 cm in the center, and the slopes downward to about 2 cm at the edge. Second cover 120 has an approximately square horizontal cross-section, with sides of 31 cm, and which additionally slopes in two dimensions from a height of about 2 cm at the corners, to 6 cm at the midpoint of the sides, and about 7 cm at the apex (all figures including the grill). One skilled in the art will appreciate that many different cover sizes and shapes are possible, and also that different sizes of a given shape could be interchanged on the mount 130.

The surface area (defined herein to mean only outer surface area when installed unless the context dictates to the contrary) of first and second covers can differ as much as desired, including for example differing by at least 5%, 10%, 20%, 30% or more. As drawn in Figure, cover 110 should be interpreted as having at least 5% larger than the surface area of second cover 120.

Each of the covers 110, 120 has an optional grill 112, 122, respectively, and the different grills can have the same or different air hole patterns. The grills 112, 122 can be made from any suitable material or materials, including preferably a speaker grill cloth (acousticloth) stretched over a plurality of perforation holes to allow sound to easily pass through. Different grills can have any suitable sizes and shapes, with the shape of first grill 112 having a surface area that exceeds the surface area of grill 122 by at least than 5%.

First and second covers 110, 120 can be made of any suitable material(s). For durability and cost-effectiveness, contemplated materials include hard plastic, although metal, wood, and other materials. Preferred materials are durable, scratch resistant, and capable of including or being colored or patterned. It is contemplated that different surface colorations can be applied to, or included within, any of the covers.

In FIG. 1, mount 130 shows an installed speaker 132. In other embodiments, a mount can include any a greater or lesser number of speakers, or other devices entirely, including for example a light, a control box, a television or other display, and so forth.

Base 140 generally comprises two flat pieces, an outer piece 142 that is rotatably coupled to an inner piece 144. Female electrical connectors 146 are attached to the inner piece 114 with bolts (not shown) and are labeled with polarity indicators 147. Base through holes 143 can be used to attach the base to an outlet box (not shown).

Inner piece 144 preferably comprises steel because it provides a high degree of durability when rotated against the outer piece 142. Inner piece 144 need not be especially strong because it is not weight supporting, and can an alternatively be constructed of hard plastic or another other suitable material. Although not shown in the figures, inner piece 144 is preferably constructed of opposing members that are screwed together about a circumferential lip (not shown) extending inwardly from the outer piece 142. In FIG. 1 the inner piece 144 is about 6.5 cm in diameter, and about 3 mm in thickness. In other contemplated embodiments the inner piece can be larger or smaller, and can have any other suitable dimensions.

Outer piece 142 needs to be relatively strong because it supports the weight of the mount 130. Steel is again currently preferred, not only for its strength but also because it is magnetically attractable. It is contemplated that plastic or non-ferrous metals could be used instead of steel, but in that case outer piece 142 should include ferrous or other magnetic contact areas that match magnets (not shown) on mount 130.

Outer piece 142 also contains base through holes 143 for coupling with an electrical outlet box. In FIG. 1, six base through holes 143 are positioned to couple with a standard outlet box popular in the USA, but all other orientations, numbers and positions of base through holes 143 that would couple to alternative outlet boxes are also contemplated.

In FIG. 1 outer piece 142 is approximately 18.5 cm in diameter, and again about 3 mm in thickness. In other contemplated embodiments outer piece 142 can be larger or smaller, and can have any other suitable dimensions. The major surface of outer piece 142 is preferably substantially flat so that magnets (not shown) of mount 120 can properly attach to any point on the major surface of outer piece 142.

Figure 2:
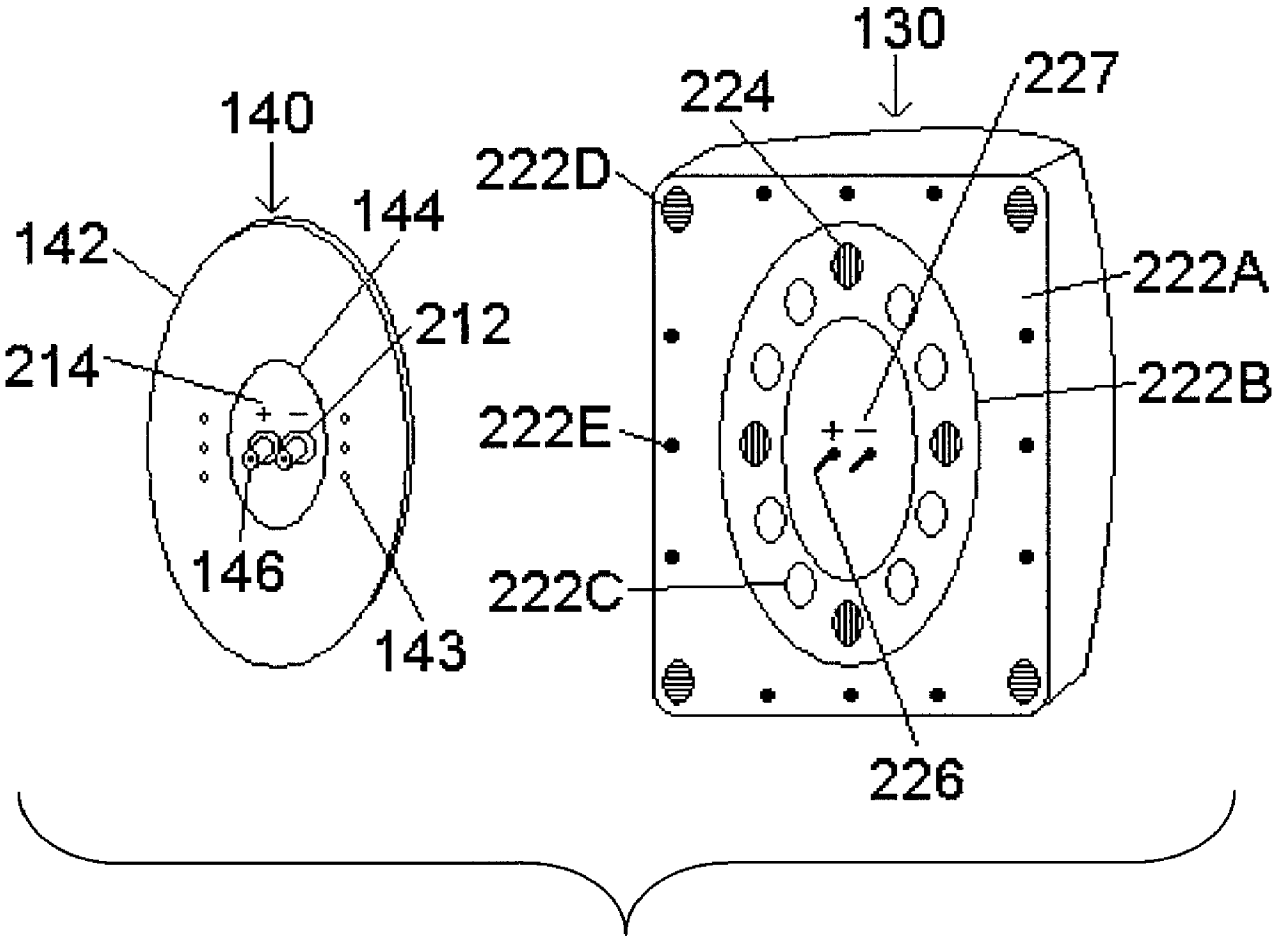
FIG. 2 is a front perspective view of the base, and a rear perspective view of the mount of FIG. 1

FIG. 2 shows the front of base 140 and the back of mount 130.

In this view base 140 shows banana jack female electrical connectors 146 held to the inner piece 144 by nuts 212. Banana couplings are preferred because they provide a particularly robust connection, and are relatively easy to orient the plug with respect to the jack. Although two separate jacks are shown, one could alternatively use a single plug and jack. In this embodiment, where there are separate connectors for positive (+) and negative (−) polarities, one can optionally include polarity designators 214.

All other suitable types of connectors are also contemplated, including for example inductive connections (not shown), simple bent wire or other bump connectors (not shown), loudspeaker connectors (not shown), D-sub connectors (not shown), and combinations thereof.

Mount 130 is a housing that generally includes a mounting surface 222, magnets 224, male electrical connectors 226, and polarity designators 227. Mount 130 can have any suitable size or shape, as appropriate to the electrical/electronic device(s) being operated inside the housing.

Mounting surface 222 has a flat area 222A that would abut a wall, ceiling or other surface upon which the mount is being placed, and further includes depression 222B sized and dimensioned to receive the base 140. The depression 222B has a plurality of magnet seats 222C (in this case 12 such seats), some of which hold magnets 224. The precise number, size, and orientation of the magnet seats 222C and magnets 224 are largely design choices, which are informed by the amount of weight to be held, the distribution of weight of mount 130, and so forth.

Mounting surface 222 also has optional feet 222D that cushion mount 130 when coupled against the base 140, and a plurality of mount through holes 222E that provide access to screws that couple the mounting surface 222 to the mount 130. Although mount 130 attaches to base 140 using magnets 224, other suitable coupling mechanisms can be used, for example quick-release tabs, hooks, screws, bolts, and nails (not shown)

Male electrical connectors 224 are banana plugs, which are sized, spaced, and oriented to mate with the female electrical connectors 146, as mount 130 is being mounted on base 140. In this embodiment, where there are separate connectors for positive (+) and negative (−) polarities, one can optionally include polarity designators 227.

Regardless of the type of connectors and manner of providing the electrical connections, it is preferred that the electrical connection is a substantially automatic. As the mount is mounted on the base, the female electrical connectors 146 should mate with the male electrical connectors 224 without a separate act. In FIG. 2, as mount 130 is placed near base 140, the magnetic force of magnets 224 upon outer surface 222 pulls male electrical connectors 224 into female electrical connectors 146. Forcing the user to manually mate the connectors in a separate act, whether with a wire nut or otherwise, is contemplated, but less preferred.

Figure 3:
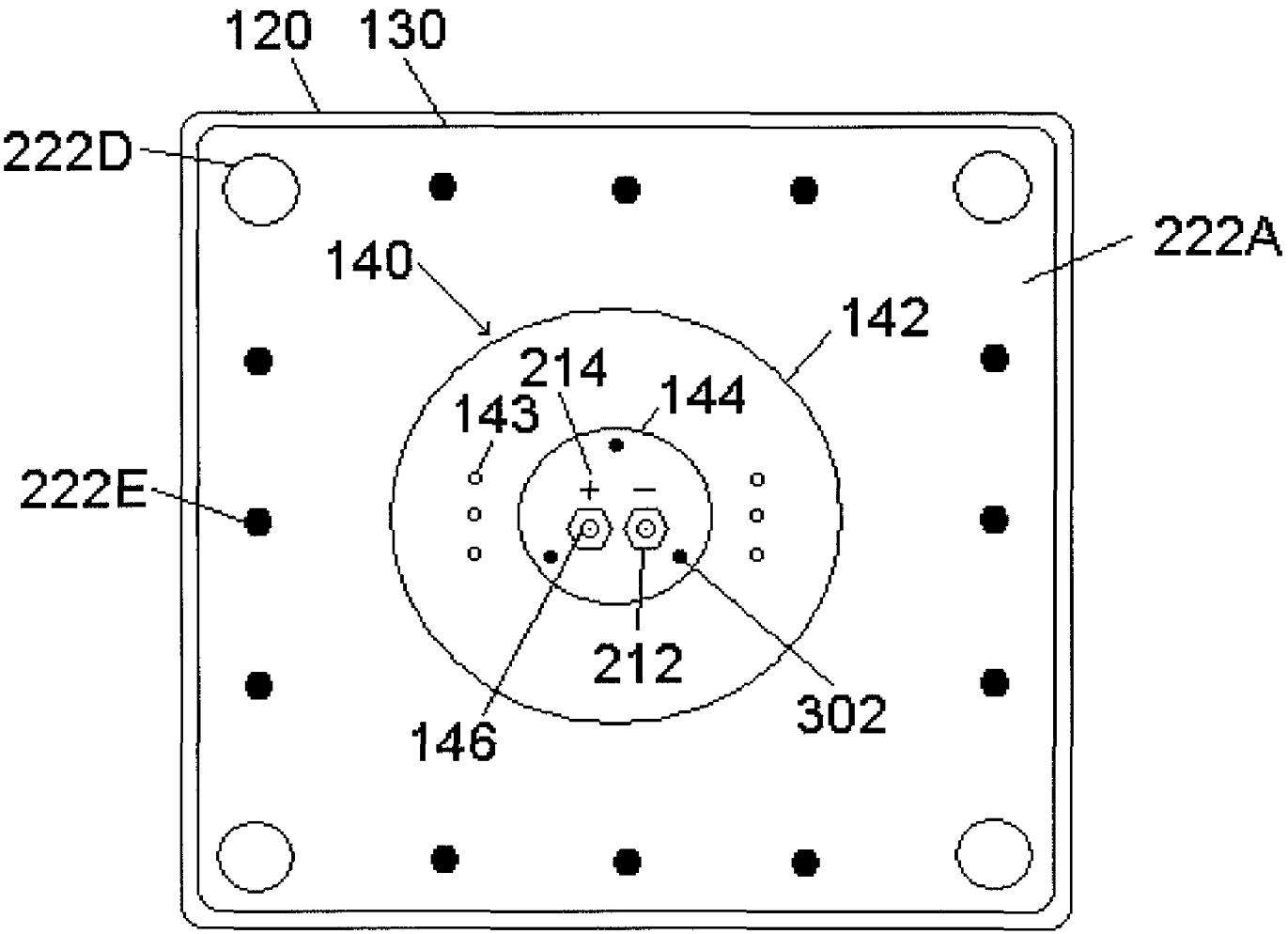
FIG. 3 is a rear view of the mount, base, and alternative second cover of FIG. 1, coupled together.

FIG. 3 is a rear view of the mount 130, base 140, and alternative second cover 120, coupled together. Mount 130 mates with alternative second cover 120 and includes mounting surface 222. Base 140 has outer piece 142 with base through holes 143, and inner piece 144 with electrical connectors 146 and screws 212.

Mount 130 has a cover 120 that can be removed for cleaning or replaced for functional or aesthetic reasons. Cover 120 is preferably attached to mount 130 without the use of hand tools, which aids in quick and easy replacement of covers.

Outer piece 140 can be attached to an outlet box with through holes 222E. Inner piece 144 can be attached to an outlet using electrical connectors 146. Electrical connectors 146 have holes (not shown) where wires can be threaded so as to create an electrical connection. Other suitable methods of connecting electrical connectors are contemplated, for example splice taps, clips, RF connectors, banana connectors, D-sub connectors, or even simple wire twists. Screws 302 hold inner piece 144 in place on a circumferential lip (not shown) extending inwardly from the outer piece 142.

Figure 4A:
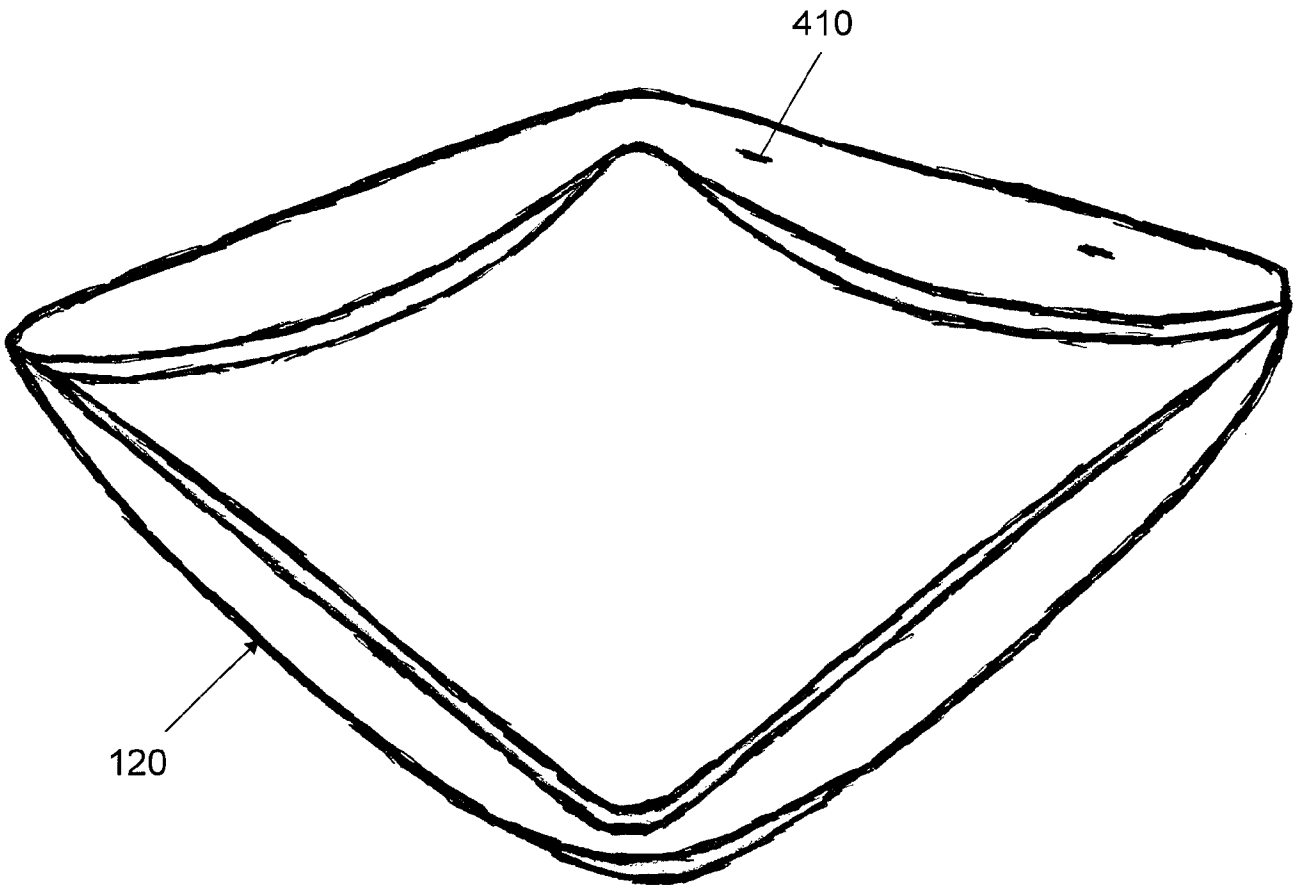
FIG. 4A is a rear perspective view of the second cover of FIG. 1.
Figure 4B:
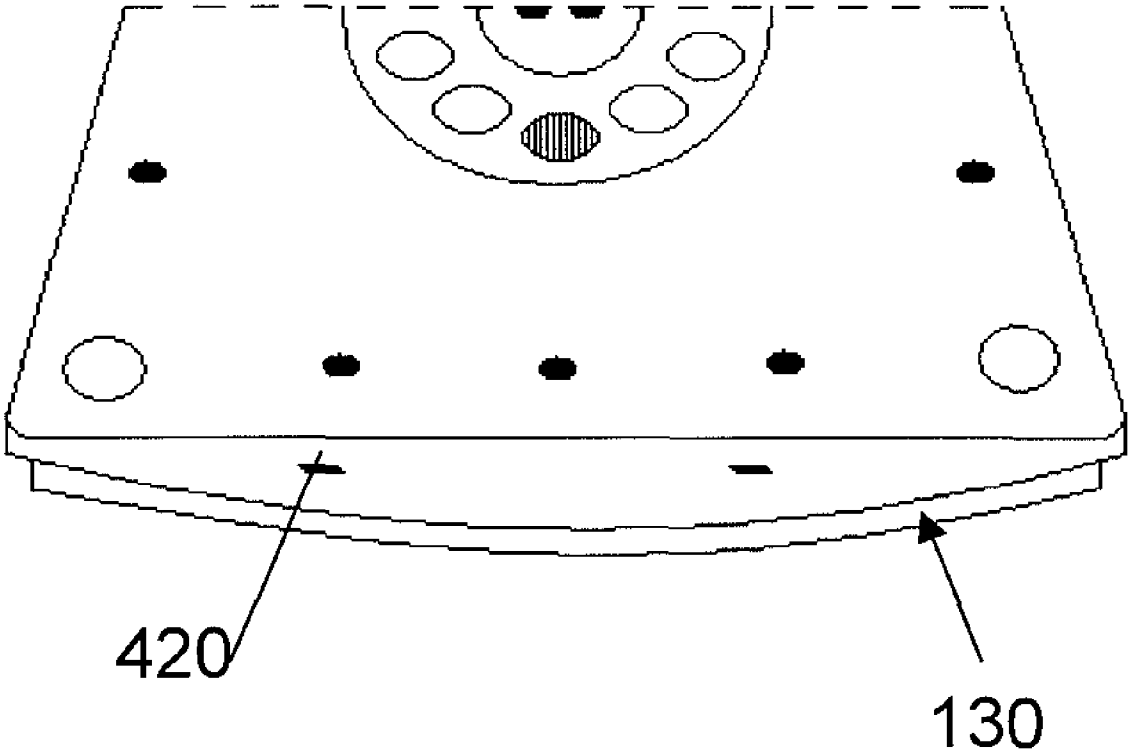
FIG. 4B is a side perspective view of a portion of the mount of FIG. 1.
Figure 5:
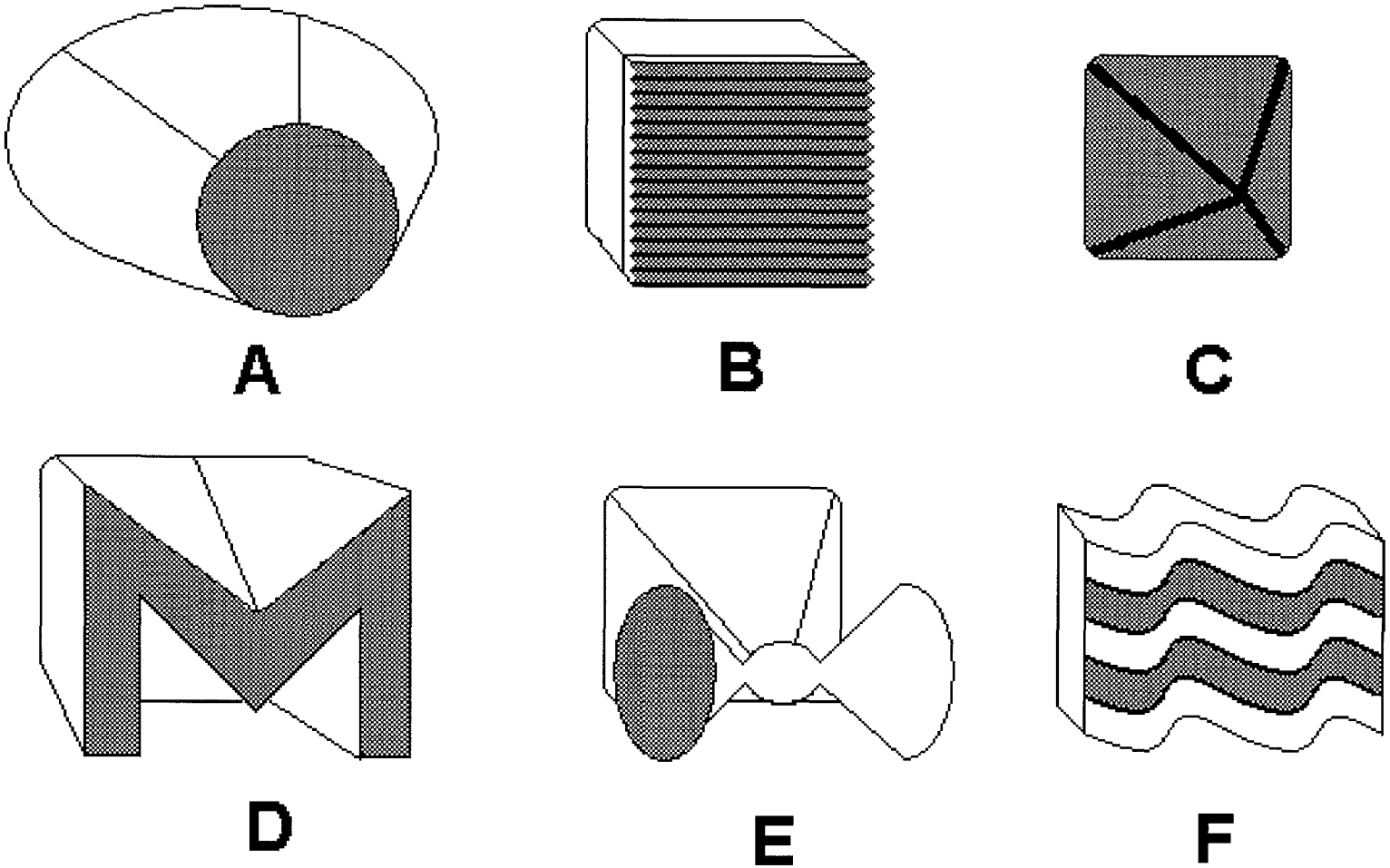
FIG. 5 is a set of five front perspective views of alternative covers for the mount of FIG. 1.

In FIG. 4A, second cover 120 has with a cavity 124 and detent 410. In FIG. 4B, mount 130 has an indent 420.

Second cover 120 has cavity 124 that mates or otherwise couples with mount 130, and is in this case is shaped to substantially match the overall contour of mount 130. Cavity 124 can be padded with a non-abrasive material to protect the exterior of mount 130.

Detent 410 is sized, shaped, and oriented to mate with indent 420. It is preferred that second cover 120 and mount 130 have a plurality of indents and detents, respectively, to provide for multiple coupling points around the perimeter of both apparatus. Detents are preferred because they provide inexpensive and reliable couplings that are easy and intuitive to use. Of course, one could use any other suitable connection means, including for example a locking tab, a hand screw, a weak adhesive, or a hook.

FIGS. 5A-E are front perspective views of the alternative different covers. These widely varying covers are included to demonstrate that any practical cover shape can be used.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A fixture system that accommodates multiple finish options, comprising:

a base having a base coupling member for coupling to an architectural structure;

a mount having a mount coupling member for coupling to the base;

first and second covers that are interchangeably mountable on the mount, the first and second covers including first and second speaker grills, respectively, and defining first and second visually apparent surface areas, respectively; and wherein the first surface area is at least 5% larger than the second surface area.

2. The system of claim 1, wherein the mount coupling member is magnetic.

3. The system of claim 1, wherein the mount coupling allows the mount to rotate relative to the base.

4. The system of claim 1, wherein the mount has a back side from which extends an electrical plug.

5. The system of claim 1, wherein the first and second grills have different surface coloration.

6. The system of claim 1, wherein the first and second grills have different shapes.

7. The system of claim 1, wherein the first and second covers have different shapes.

8. The system of claim 7, wherein each of the covers defines a cavity having an opening, and wherein the openings of the covers are substantially curved and rectangular, respectively.

9. The system of claim 7, wherein the first and second covers have substantially curved and rectangular perimeters, respectively.

10. The system of claim 1, wherein the first surface area is at least 20% larger than the second surface area.

11. The system of claim 1, wherein the first surface area is at least 30% larger than the second surface area.

12. The system of claim 1, wherein the first cover has a different overall shape from that of the mount.

13. The system of claim 1, further comprising a detent that facilitates maintaining a disposition of the cover on the mount.

* * * * *